US005560132A

United States Patent [19]

Merlino

[11] Patent Number: 5,560,132

[45] Date of Patent: Oct. 1, 1996

[54] AUTOMATIC SAFETY DEVICE FOR A REVOLVER ON THE HAMMER

[75] Inventor: Giacomo Merlino, Sarezzo-Ponte Zanano, Italy

[73] Assignee: Uberti Aldo & C. S.r.l., Brescia, Italy

[21] Appl. No.: 421,417

[22] Filed: Apr. 13, 1995

[51] Int. Cl.[6] ..... F41A 17/74

[52] U.S. Cl. ..... 42/66; 42/70.08

[58] Field of Search ..... 42/66, 65, 70.08, 42/69.03

[56] References Cited

U.S. PATENT DOCUMENTS

| | | | |
|---|---|---|---|
| 600,337 | 3/1898 | Richardson | 42/66 |
| 917,045 | 4/1909 | Gates | 42/66 |
| 961,189 | 6/1910 | Wesson | 42/66 |
| 3,157,958 | 11/1964 | Lewis | 42/66 |
| 3,482,348 | 12/1969 | Zanchi | 42/66 |
| 3,626,622 | 12/1971 | Uberti | 42/66 |
| 3,988,848 | 11/1976 | Chatigny | 42/66 |
| 4,316,340 | 2/1982 | Kahn | 42/66 |
| 4,621,445 | 11/1986 | Rohm | 42/66 |
| 4,680,884 | 7/1987 | Smith, Jr. et al. | 42/66 |
| 4,962,606 | 10/1990 | Pozzi | 42/66 |

FOREIGN PATENT DOCUMENTS

| | | | |
|---|---|---|---|
| 1909248 | 9/1970 | Germany | 42/66 |
| 1909249 | 9/1970 | Germany | 42/66 |
| 1914870 | 10/1970 | Germany | 42/66 |
| 1917716 | 10/1970 | Germany | 42/66 |
| 2113745 | 10/1972 | Germany | 42/66 |

*Primary Examiner*—Michael J. Carone
*Assistant Examiner*—Theresa M. Wesson
*Attorney, Agent, or Firm*—McGlew and Tuttle, P.C.

[57] ABSTRACT

The invention relates a safety device on the hammer for revolvers which comprises a safety slide (20) guided in a seat (22) formed in the frame (11) of revolver, laterally to the hammer (12) and having a blocking tooth (21) transversely extending between the breech (11') of the frame and the front face (12') of the hammer. The safety slide is movable up and down, to an active upper position and an inactive lower position, and an entraining pin (25) located on the hammer interacts with the safety slide to move it in the inactive lower position when the hammer turns from the armed position to the percussion position.

17 Claims, 1 Drawing Sheet

AUTOMATIC SAFETY DEVICE FOR A REVOLVER ON THE HAMMER

FIELD OF THE INVENTION

The present invention relates to safety devices for firearms or breech loading revolvers and, more particularly, to an automatic safety device for firearms.

BACKGROUND OF THE INVENTION

In the field of revolvers, safety devices are well known for the purpose of preventing accidental discharges due to the dropping of the firearm or due to the careless of the operator while handling the revolver or the hammer thereof.

A known safety device is for instance the IT-882218 patent.

It consists of a pushing element pivotably connected to the yoke and having a lower finger and an upper appendix and angularly movable in a plane parallel to the back face of the yoke; a pusher axially movable and cooperating with the trigger's blocking tooth; and an inclined upper surface near the upper extremity of the pusher for positioning the balance lever between the hammer and the back face of the yoke.

However, this device, as the known safety devices, is quite complex and expensive and it is necessary to make the seats in the hammer in the different directions for all the safety elements. In fact, the safety elements are almost exclusively positionated in the body of the trigger.

SUMMARY AND OBJECTS OF THE INVENTION

On the contrary, the object of the present invention is to provide an automatic safety device for a revolver on the hammer obtained by a new original arrangement and combination of the elements in order to have an easier, safer and cheaper device.

Another object of the present invention is to provide an automatic safety device for a revolver having a limited number of elements, only one of these is in the body of the hammer while the other ones are in the frame beside the hammer.

The advantage of this invention is to simplify the workings and operations to assemble the elements.

The present invention accomplishes these objectives by having a hammer rotatably mounted on the frame of a fire arm. The hammer is rotatable between an arm position and a percussion position. In between the hammer and the frame is a slide which is movable between an active position and an inactive position, a blocking means blocks the hammer from fully reaching the percussion position when the slide is in the active position. When the slide is in the inactive position, the blocking means does not block the hammer from reaching the percussion position. The hammer can then reach the percussion position depending on the position of other structure of the fire arm. The present invention also includes an entraining means for moving the slide from the active position to the inactive position. A spring is provided to move the slide from the inactive position to the active position when so allowed by the entraining means.

The entraining means includes a protrusion on the slide and an entraining pin on the hammer. When the hammer is in the arm position and the slide is in the active position, the entraining pin is on an operative side of the protrusion. When the hammer moves from the armed position to the percussion position, the entraining pin pushes against the operative side of the protrusion, and pushes the protrusion, and the slide, from the active position to the inactive position. During this moving from the arm position to the percussion position, the entraining pin slides over the protrusion once the slide has reached the inactive position. When the hammer is in the percussion position, the entraining pin is on the non-operative side of the protrusion and when the hammer is moved from the percussion position to the arm position, the entraining pin does not block the protrusion or the slide from being moved by the spring to the active position. When the hammer is moving into the armed position from the percussion position the slide is in the active position, and as the hammer is just about to enter the arm position, the entraining pin slides over the protrusion and onto the operative side of the protrusion.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 3:
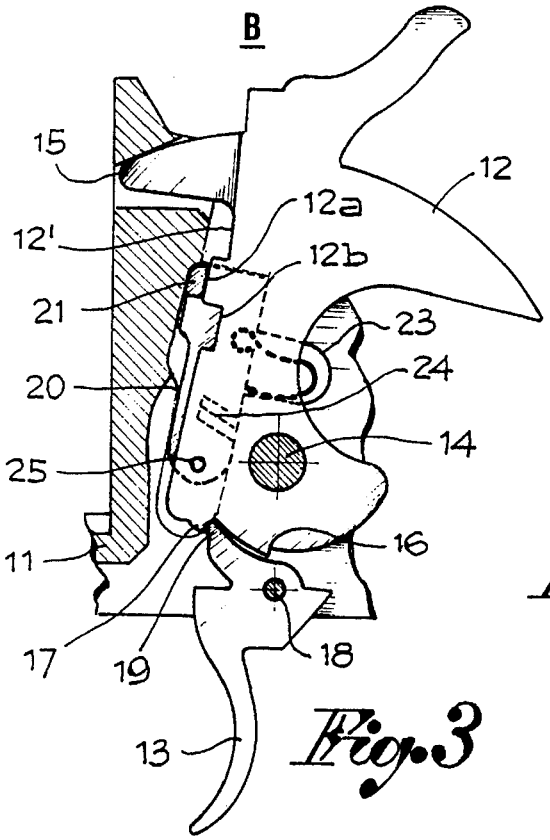
FIG. 3 is a view like FIG. 1 but the hammer is in the safety position and the safety device is active.

The above drawings only show some elements of a revolver, particularly a sectional view of the frame 11, the hammer 12 and the trigger 13.

The hammer 12 is assembled on the frame 11 and is pivotable on an axis 14 between an armed position A and a percussion position P. On the front face 12', the hammer 12 can have a firing pin portion which can have a firing pin 15 or can act on a firing pin which is on the frame 11. Besides, the hammer 12 is actuated by a spring, which is not drawn, moving and normally seating in the percussion position. The armed position is obtained by a displacement of the hammer in opposition to the action the spring.

In the lower part, seen in profile, the hammer 12 has a cock notch 16 and a safety notch 17. The trigger is blocked or mounted in the frame 11 on an axis 18 which is parallel to the axis of the hammer. The trigger has a spout 19 interfering with and engaging the cock notch 16 of the hammer 12 to block the hammer in the armed position A. The spout 19 of the trigger 13 can also interfere with the safety notch 17 of the hammer to block it in the intermediate safety position B if the armed position of the hammer is incomplete or the spout of the trigger disjoins from the cock notch of the hammer.

The present invention provides, between the frame 11 and a side of the hammer 12, and below the firing pin 15 a safety slide 20 having a blocking means with a tooth 21 transversally located between the breech of the frame 11 and the front face 12' of the hammer. That is, the safety slide 20 is positioned, and vertically moves, in the seat 22 positioned in the frame 11. The safety slide 20 is movable between an active upper position and an inactive lower position. These positions are two extreme positions of the slide 20 and suitably limited.

The slide 20 is actuated by a slide spring means 23 which is positioned in the frame 11 in order to normally hold the safety slide 20 in its upper position, that is active.

The safety slide 20 is in the active position both when the hammer is in the armed position, when the trigger interacting with the safety notch, and when the hammer is in the intermediate safety position, blocked by the trigger which interacts with the safety notch 17. The displacement of the slide into the lower and inactive position is by an entraining means and only happens when the hammer moves from the armed position to the percussion one.

Figure 4:
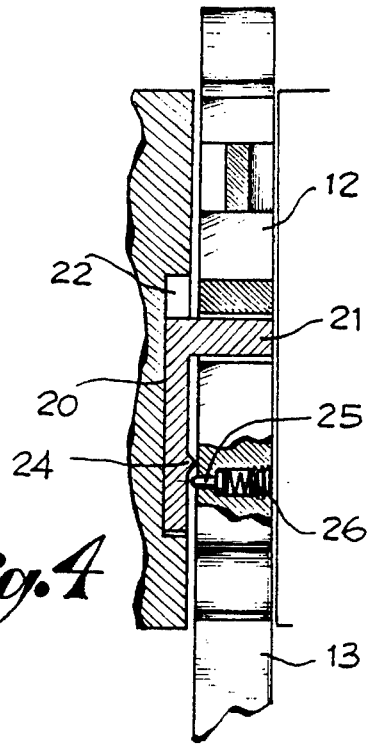
FIG. 4 is a sectional view taken along the line IV—IV of FIG. 1.

The entraining means includes on the face of the slide 20 towards the hammer 12 a cam protrusion 24 (see FIG.4) and includes in the hammer 12 there an entraining pin 25 which is actuated by a pin spring 26 towards a face of the safety slide 20. The entraining pin 25 interacts with the cam protrusion 24 when the hammer turns on the own axis 14 between the percussion position P and the armed position A and vice versa.

Please note that on the front face 12' of the hammer 12, at the safety slide 20 level there is an appendix **12*a*, leaning on a blocking tooth 21 when the safety slide is lifted up to the active position, and a carved indentation 12*b* which receives the blocking tooth 21 when the safety slide is down and inactive. In the first position the blocking tooth 21 of the safety slide 20** prevents the hammer from hitting the ammunition. In the second position the hammer can regularly work and hit, percussion position P, without difficulty.

Figure 1:
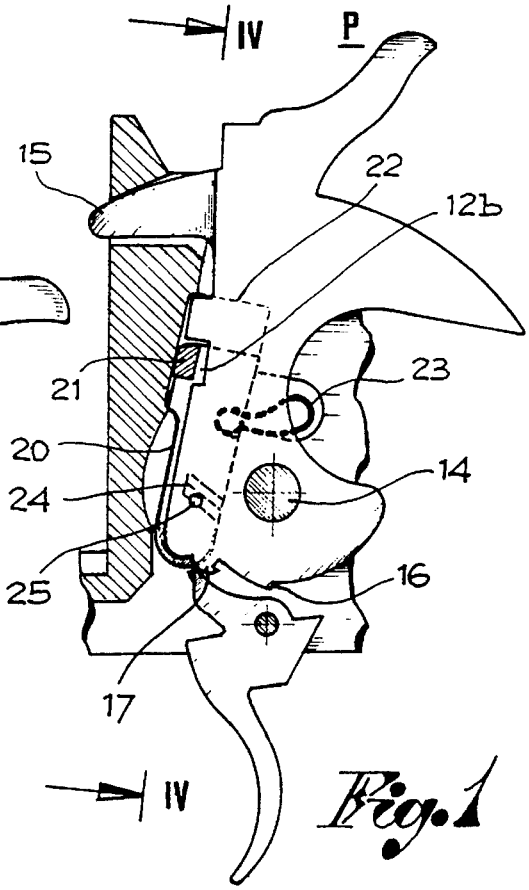
FIG. 1 is a sectional view of the revolver showing the unloaded position of the hammer, and the inactive safety device.

This second position of the safety slide is shown on FIG. 1 where the safety slide 20 is just down. Its blocking tooth 21 is at the level of the carved indentation **12*b* of the hammer 12**, and t he hammer is forward in order that the firing pin can hit the ammunition.

Besides, in such a position the entraining pin 25 positioned in the hammer 12 is below or on a non-operative side of the cam protrusion of the safety slide 20.

Figure 2:
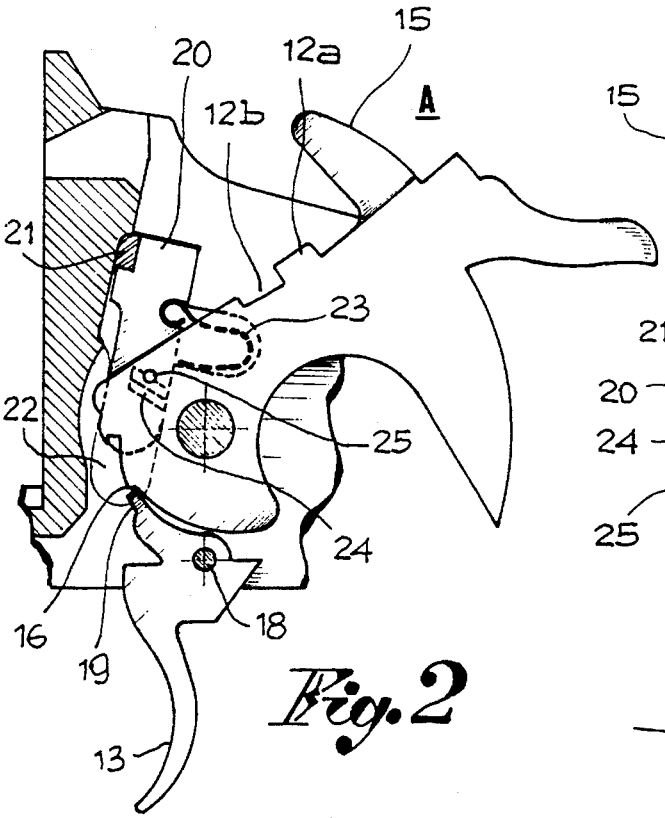
FIG. 2 is a view like FIG.1 but the hammer is in the armed position and the safety device is active.

Because of the above as soon as the hammer 12 is turned towards the armed position A - see FIG. 2 - the safety slide 20 is free to move upward when is actuated by the spring 23 up to its active position.

The entraining pin 25 is still below the cam protrusion 24.

Then, when the safety slide 20 reaches the top, the further rotation of the hammer allows the entraining pin 25 to be at the level of the cam protrusion 24. Then, the entraining pin 25 in contact with this protrusion 24 is forced to withdraw against the action of its spring 26 and to go above the protrusion 24 to an operative side, as FIG. 2 shows, where the hammer is hooked by the cock notch 16 of the trigger.

The revolver can shoot the ammunition by acting on the trigger to unhook the hammer. Then by turning of the hammer, which is act actuated by its spring towards the percussion position P the entraining pin 25 acts downwards on the cam protrusion 24 and lowers the safety slide into the inactive position before the hammer hits. The blocking tooth 21 of the safety slide 20 is at the level of the carved indentation **12*b* of the hammer in order not to interfere with the percussion of the latter, that is in the same position as FIG. 1** shows.

On the contrary, when the hammer is incompletely cocked and/or is blocked by the trigger on the safety notch 17 as FIG. 3 shows, the safety slide 20, actuated by the spring 23 is in the upper or operative position and its blocking tooth 21 intercepts the appendix **12*a* of the hammer in order that the appendix and the firing pin 15** don't reach the percussion position.

So the gun is in the safety position and it cannot shoot until you willingly act on the hammer and turn it in the armed position. Only after the hammer has been turned into the armed position CE the safety slide, driven by the entraining pin on the hammer, be lowered and the gun can shoot.

What I claim is:

1. A safety device on the hammer for revolvers having a frame;

a hammer pivoted on the frame, with a cock notch and a safety notch and angularly movable between an armed position and a percussion position;

a trigger having a spout interacting with the cock notch to stop the hammer in the armed position said spout interacting with the safety notch to stop the hammer in an intermediate safety position;

a safety slide guided in a seat located in the frame laterally to the hammer and having a blocking tooth transversely displaced between the frame and a front face of the hammer, below a firing pin of the hammer, said safety slide with the blocking tooth being movable up and down, to an active upper position and an inactive lower position;

a spring located in the frame acting on the safety slide to move it and normally hold it in the active upper position when the hammer is turned from the percussion position to the armed position and when the hammer is stopped at the safety position; and an entraining pin located on the hammer and interacting with said safety slide to move the slide into the inactive lower position when the hammer turns from the armed position to the percussion position, the safety slide with the blocking tooth in the active upper position interferes and prevents the hammer from reaching the percussion position, the safety slide with the blocking tooth in the inactive lower position enables the hammer to reach the percussion position.

2. The safety device of claim 1, wherein said safety slide on a face towards the hammer has a cam protrusion and said entraining pin on the hammer interacts with said cam protrusion at least to move the safety slide to the inactive lower position consequently to the rotation of the hammer from the armed position to the percussion position.

3. The safety device of claim 2, wherein on its front face, the hammer has an appendix laying on the blocking tooth of the safety slide when said safety slide is in the active upper position, and a carved indentation which can receive the blocking tooth of the safety slide when said slide is in the inactive position.

4. The safety device of claim 2, wherein said entraining pin is actuated by a springs to lean out, and to return in, the hammer, and go over consequently to the rotation of the hammer, said pin is above this cam protrusion when the hammer is in the armed position.

5. The safety device of claim 4, wherein on its front face, the hammer has an appendix laying on the blocking tooth of the safety slide when said safety slide is in the active upper position, and a carved indentation which can receive the blocking tooth of the safety slide when said slide is in the inactive position.

6. The safety device of claim 1, wherein on its front face, the hammer has an appendix laying on the blocking tooth of the safety slide when said safety slide is in the active upper position, and a carved indentation which can receive the blocking tooth of the safety slide when said slide is in the inactive position.

7. A safety device for a firearm, the device comprising:

a frame;

a hammer pivotally mounted on said frame between an armed position and a percussion position;

a slide movable mounted in said frame between an active and an inactive position, said slide including a blocking means for blocking said hammer from entering said percussion position when said slide is in said active position and for not blocking said hammer from entering said percussion position when said slide is in said inactive position;

slide spring means for biasing said slide towards said active position; and entraining means for moving said slide from said active position to said inactive position when said hammer moves from said armed position to said percussion position, said entraining means causing said slide spring means to move said slide from said inactive position to said active position when said hammer moves from said percussion position to said armed position.

8. A device in accordance with claim 7, wherein:

said entraining means includes an entraining pin positioned on said hammer and interacting with said slide to move said slide from said active position to said inactive position when said hammer moves from said armed position to said percussion position, said interacting of said entraining pin with said slide also causing said slide spring means to move said slide from said inactive position to said active position when said hammer moves from said percussion position to said armed position.

9. A device in accordance with claim 8, wherein:

said entraining means includes a protrusion positioned on said slide and interacting with said entraining pin of said hammer to move said slide from said active position to said inactive position when said hammer moves from said armed position to said percussion position.

10. A device in accordance with claim 9, wherein:

said interacting of said protrusion with said entraining pin also causing said slide spring means to move said slide from said inactive position to said active position when said hammer moves from said percussion position to said armed position.

11. A device in accordance with claim 9, wherein:

said entraining pin is movable toward and away from said hammer, said entraining pin being positioned on an operative side of said protrusion when said hammer is in said armed position.

12. A device in accordance with claim 11, wherein:

said entraining pin pushes against said operative side of said protrusion to move said slide to said inactive position when said hammer moves from said armed position to said percussion position.

13. A device in accordance with claim 12, wherein:

said entraining pin slides over said protrusion to a non-operative side of said protrusion when said hammer moves in a direction from said armed position to said percussion position and said slide is in said inactive position.

14. A device in accordance with claim 13, wherein:

said entraining pin slides over said protrusion to said operative side of said protrusion when said hammer moves in a direction from said percussion position to said armed position and said slide is in said active position.

15. A device in accordance with claim 7, wherein:

said entraining means includes a protrusion positioned on said slide and interacting with said hammer to move said slide from said active position to said inactive position when said hammer moves from said armed position to said percussion position, said interacting of said protrusion with said hammer also causing said slide spring means to move said slide from said inactive position to said active position when said hammer moves from said percussion position to said armed position.

16. A device in accordance with claim 7, wherein:

said hammer includes an appendix and an indentation;

said blocking means includes a blocking tooth positioned between said frame and said appendix of said hammer when said slide is in said active position to block said hammer from said percussion position, said blocking tooth being positioned between said frame and said indentation of said hammer when said slide is in said inactive position to not block said hammer from said percussion position.

17. A device in accordance with claim 16, wherein:

said hammer includes a firing pin portion, a cock notch and a safety notch;

a trigger is mounted pivotally on said frame, said trigger includes a spout interacting with said cock notch to hold said hammer in said armed position, said spout also interacts with said safety notch to hold said hammer in an intermediate position;

said entraining means includes a pin spring for biasing said pin in a direction outward of said hammer;

said blocking tooth is positioned between said firing pin portion and said trigger; and said frame defines a seat in which said slide moves, said seat limiting movements of said slide.

* * * * *

UNITED STATES PATENT AND TRADEMARK OFFICE

CERTIFICATE OF CORRECTION

PATENT NO. : 5,560,132
DATED : October 1, 1996
INVENTOR(S) : MERLINO

It is certified that error appears in the above-indentified patent and that said Letters Patent is hereby corrected as shown below:

On the title page, please insert the following:

item --[30] Foreign Application Priority Data

November 3, 1994 [IT] Italy ..... BS94A000128---.

Signed and Sealed this

Eleventh Day of February, 1997

Bruce Lehman

*Attest:*

BRUCE LEHMAN

*Attesting Officer*

*Commissioner of Patents and Trademarks*